US012078180B2

(12) United States Patent
Mi et al.

(10) Patent No.: US 12,078,180 B2
(45) Date of Patent: Sep. 3, 2024

(54) CENTRIFUGAL COMPRESSOR HAVING A MOTOR COOLING PASSAGE

(71) Applicant: Carrier Corporation, Palm Beach Gardens, FL (US)

(72) Inventors: Tingcan Mi, Shanghai (CN); Kai Deng, Shanghai (CN); Lei Yu, Shanghai (CN); Guangyu Shen, Shanghai (CN); Fei Xie, Shanghai (CN); Yuhui Kuang, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/254,924

(22) PCT Filed: Sep. 10, 2020

(86) PCT No.: PCT/US2020/050089

§ 371 (c)(1),
(2) Date: Dec. 22, 2020

(87) PCT Pub. No.: WO2021/050655

PCT Pub. Date: Mar. 18, 2021

(65) Prior Publication Data

US 2022/0196299 A1 Jun. 23, 2022

(30) Foreign Application Priority Data

Sep. 12, 2019 (CN) ..... 201910863342.9

(51) Int. Cl.
*F04D 25/06* (2006.01)
*F04D 17/12* (2006.01)
(Continued)

(52) U.S. Cl.
CPC ..... *F04D 25/0606* (2013.01); *F04D 17/122* (2013.01); *F04D 29/056* (2013.01);
(Continued)

(58) Field of Classification Search
CPC ..... F04D 25/0626; F04D 29/002
See application file for complete search history.

(56) References Cited

U.S. PATENT DOCUMENTS 3,891,355 A 6/1975 Hecht et al.
3,922,114 A * 11/1975 Hamilton ..... F04C 29/045 417/372

(Continued)

FOREIGN PATENT DOCUMENTS

EP 2009285 B1 9/2016
EP 2090780 B1 5/2017

(Continued)

OTHER PUBLICATIONS

International Search Report and Written Opinion for Application No. PCT/US2020/050089; Issued Mar. 15, 2021; 22 Pages.

(Continued)

*Primary Examiner* — Nathan C Zollinger
*Assistant Examiner* — Timothy P Solak
(74) *Attorney, Agent, or Firm* — CANTOR COLBURN LLP

(57) ABSTRACT

A centrifugal compressor and a refrigerating device. The centrifugal compressor includes: a shell, which has a fluid inlet and a fluid outlet; a motor assembly including a stator and a rotor, the rotor including a vertically arranged rotor shaft; a centrifugal compression mechanism, an impeller of which is connected with the rotor shaft so as to be driven by the motor assembly, wherein the centrifugal compression mechanism is arranged downstream of the fluid inlet to receive fluid, compress and pressurize the fluid, and output the pressurized fluid in a direction away from the motor assembly; and a guide member, which receives the pressurized fluid from the centrifugal compression mechanism, and which defines a flow passage alone or together with a part of the shell, wherein the flow passage is configured such that (Continued)

the pressurized fluid from the centrifugal compression mechanism passes through and cools the motor assembly.

9 Claims, 2 Drawing Sheets

(51) Int. Cl.

| | |
|---|---|
| ***F04D 29/056*** | (2006.01) |
| ***F04D 29/063*** | (2006.01) |
| ***F04D 29/42*** | (2006.01) |
| ***F04D 29/58*** | (2006.01) |
| ***F25B 31/02*** | (2006.01) |
| *F25B 31/00* | (2006.01) |

(52) U.S. Cl.
CPC ..... *F04D 29/063* (2013.01); *F04D 29/4206* (2013.01); *F04D 29/584* (2013.01); *F25B 31/026* (2013.01); *F04D 29/5806* (2013.01); *F25B 31/006* (2013.01)

(56) References Cited

U.S. PATENT DOCUMENTS

| | | | | |
|---|---|---|---|---|
| 4,477,233 | A | 10/1984 | Schaefer | |
| 4,838,769 | A | 6/1989 | Gannaway | |
| 5,263,822 | A | 11/1993 | Fujio | |
| 5,295,808 | A | 3/1994 | Machida et al. | |
| 5,350,039 | A * | 9/1994 | Voss | F04D 25/06 62/505 |
| 5,511,389 | A | 4/1996 | Bush et al. | |
| 5,533,875 | A * | 7/1996 | Crum | F04C 29/023 418/94 |
| 5,624,243 | A | 4/1997 | Omodaka et al. | |
| 5,980,218 | A | 11/1999 | Takahashi et al. | |
| 6,634,870 | B2 | 10/2003 | Dreiman et al. | |
| 6,708,520 | B2 | 3/2004 | Yasunori et al. | |
| 6,769,267 | B2 * | 8/2004 | Ebara | F04C 29/068 62/505 |
| 7,293,970 | B2 | 11/2007 | Sato | |
| 7,451,616 | B2 | 11/2008 | Ro | |
| 8,177,525 | B2 | 5/2012 | Takahashi et al. | |
| 8,221,096 | B2 | 7/2012 | Taniwa et al. | |
| 8,513,851 | B2 | 8/2013 | Tsukamoto et al. | |
| 2003/0143093 | A1 * | 7/2003 | Mabe | F04B 35/04 417/423.8 |
| 2006/0099086 | A1 * | 5/2006 | Morozumi | F04C 29/02 417/65 |
| 2017/0306951 | A1 * | 10/2017 | Chikano | F04C 23/008 |
| 2018/0356129 | A1 * | 12/2018 | Creamer | F04C 18/02 |
| 2019/0055954 | A1 * | 2/2019 | Egawa | F04D 29/057 |

FOREIGN PATENT DOCUMENTS

| | | | |
|---|---|---|---|
| EP | 3401549 | A1 | 11/2018 |
| JP | H05223090 | A | 8/1993 |
| JP | H11294879 | A | 10/1999 |
| JP | 2007177634 | A | 7/2007 |

OTHER PUBLICATIONS

Invitation to Pay Additional Fees and, Where Applicable, Protest Fee for Application No. PCT/US2020/050089; 12 Pages.

* cited by examiner

CENTRIFUGAL COMPRESSOR HAVING A MOTOR COOLING PASSAGE

CROSS REFERENCE TO RELATED APPLICATIONS

This application is a National Stage of International Application Serial No. PCT/US2020/050089, filed Sep. 10, 2020, which claims the benefit of CN Application No. 201910863342.9, filed on Sep. 12, 2019, which is incorporated herein by reference in its entirety.

FIELD OF THE INVENTION

The present disclosure relates to the field of compressors; more specifically, the present disclosure relates to a centrifugal compressor and a refrigerating device having the same.

BACKGROUND OF THE INVENTION

For centrifugal compressors, they are often used in large refrigerating units and typically use bearings that do not require lubrication oil (oil-free bearings). When high-speed small centrifugal compressors are desired, the cost of high-speed oil-free bearings is too high. It is therefore desirable to provide bearings that require the use of lubrication oil and to design simplified lubrication oil passages. On the other hand, it is desirable to simplify the structure of the centrifugal compressor, so that a compact and small centrifugal compressor can be provided.

SUMMARY OF THE INVENTION

An object of the present disclosure is to solve or at least alleviate the problems existing in the related art.

In an aspect, a centrifugal compressor, especially a centrifugal compressor adapted to be vertically arranged, is provided, which includes:

- a shell, which has a fluid inlet and a fluid outlet, the fluid inlet being located at a top of the shell;
- a motor assembly, which is arranged in the shell and includes a stator and a rotor, the rotor including a vertically arranged rotor shaft, and the rotor shaft including a lower end and an upper end;
- a centrifugal compression mechanism, an impeller of which is connected with the rotor shaft so as to be driven by the motor assembly, wherein the centrifugal compression mechanism is arranged downstream of the fluid inlet to receive fluid, compress and pressurize the fluid, and output the pressurized fluid in a direction away from the motor assembly; and
- a guide member, which receives the pressurized fluid from the centrifugal compression mechanism, and which defines a flow passage alone or together with a part of the shell, wherein the flow passage is configured such that the pressurized fluid from the centrifugal compression mechanism passes through and cools the motor assembly and is discharged from the fluid outlet.

Optionally, in an embodiment of the centrifugal compressor, the guide member is a pipe.

Optionally, in an embodiment of the centrifugal compressor, the guide member is partially or completely located outside the shell.

Optionally, in an embodiment of the centrifugal compressor, the guide member has a first end connected to an output port of the centrifugal compression mechanism, a second end connected to a side wall of the shell, such as a lower part of the side wall of the shell, and a pipe body connected between the first end and the second end and including a curved part.

Optionally, in an embodiment of the centrifugal compressor, the rotor shaft is supported by a first bearing at a lower part and a second bearing at an upper part, a bottom part of the shell has an oil tank, and the lower end of the rotor shaft is located in the oil tank; the rotor shaft defines an axial or oblique oil passage therein, and has radial perforations at positions corresponding to the first bearing and the second bearing.

Optionally, in an embodiment of the centrifugal compressor, the motor assembly includes:

- a motor housing;
- a stator fixed on an inner side of the motor housing;
- a rotor located radially inwardly of the stator, the rotor being capable of rotating relative to the stator when the motor assembly is energized;
- a first bearing seat at a bottom of the motor housing and a first bearing therein;
- an oil cup at a top of the motor housing; and
- a second bearing bracket located above the oil cup and a second bearing therein.

Optionally, in an embodiment of the centrifugal compressor, the bottom of the motor housing is connected to the shell through a support bracket, the top of the motor housing is connected to the second bearing bracket, and the second bearing bracket is supported by the shell; the oil cup includes an oil guide pipe that is arranged obliquely to guide oil in the oil cup to an inner wall of the shell so that the oil is returned to the oil tank.

Optionally, in an embodiment of the centrifugal compressor, the centrifugal compression mechanism includes one or more compression stages.

Optionally, in an embodiment of the centrifugal compressor, the centrifugal compression mechanism includes a first-stage impeller, a partition, a volute, and a second-stage impeller, wherein an outlet of the volute communicates with the fluid outlet of the shell, the fluid passes between an upper surface of the volute and the partition after being compressed by the first-stage impeller, is then compressed by the second-stage impeller, and then exits via the output port of the volute.

In another aspect, a refrigerating device is provided, which includes the centrifugal compressor according to various embodiments.

BRIEF DESCRIPTION OF THE DRAWINGS

The contents of the present disclosure will become easier to understand with reference to the accompanying drawings. It can be easily understood by those skilled in the art that the drawings are merely used for illustration, and are not intended to limit the scope of protection of the present disclosure. In addition, like parts are denoted by like numerals in the drawings, wherein.

DETAILED DESCRIPTION OF THE EMBODIMENT(S) OF THE INVENTION

Figure 1:
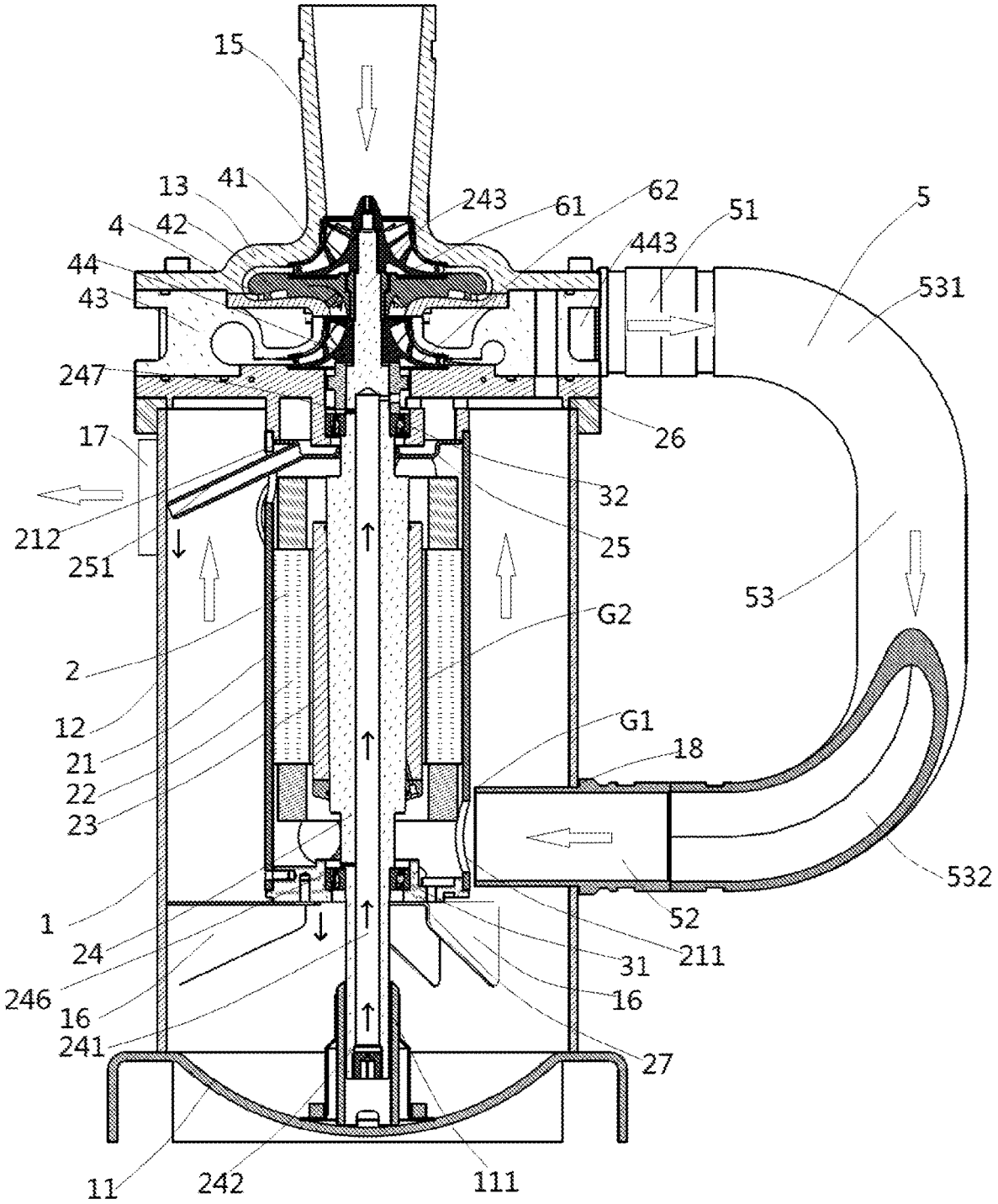
FIG. 1 shows a cross-sectional view of a centrifugal compressor according to an embodiment of the present disclosure.

It can be easily understood that according to the technical solutions of the present disclosure, without changing the essential spirit of the present disclosure, those skilled in the art can propose a variety of mutually replaceable structural modes and implementations. Therefore, the following specific embodiments and the accompanying drawings are merely exemplary illustrations of the technical solutions of the present disclosure, and should not be regarded as the entirety of the present disclosure or as definitions or limitations to the technical solutions of the present disclosure.

The orientational terms that have been mentioned or might be mentioned in this specification, such as "upper", "lower", "left", "right", "front", "rear", "front side", "back side", "top", "bottom", etc., are defined relative to the configurations shown in the drawings. They are relative concepts, so they may change accordingly according to their different locations and different states of use. Therefore, these or other orientational terms should not be interpreted as restrictive terms.

Figure 2:
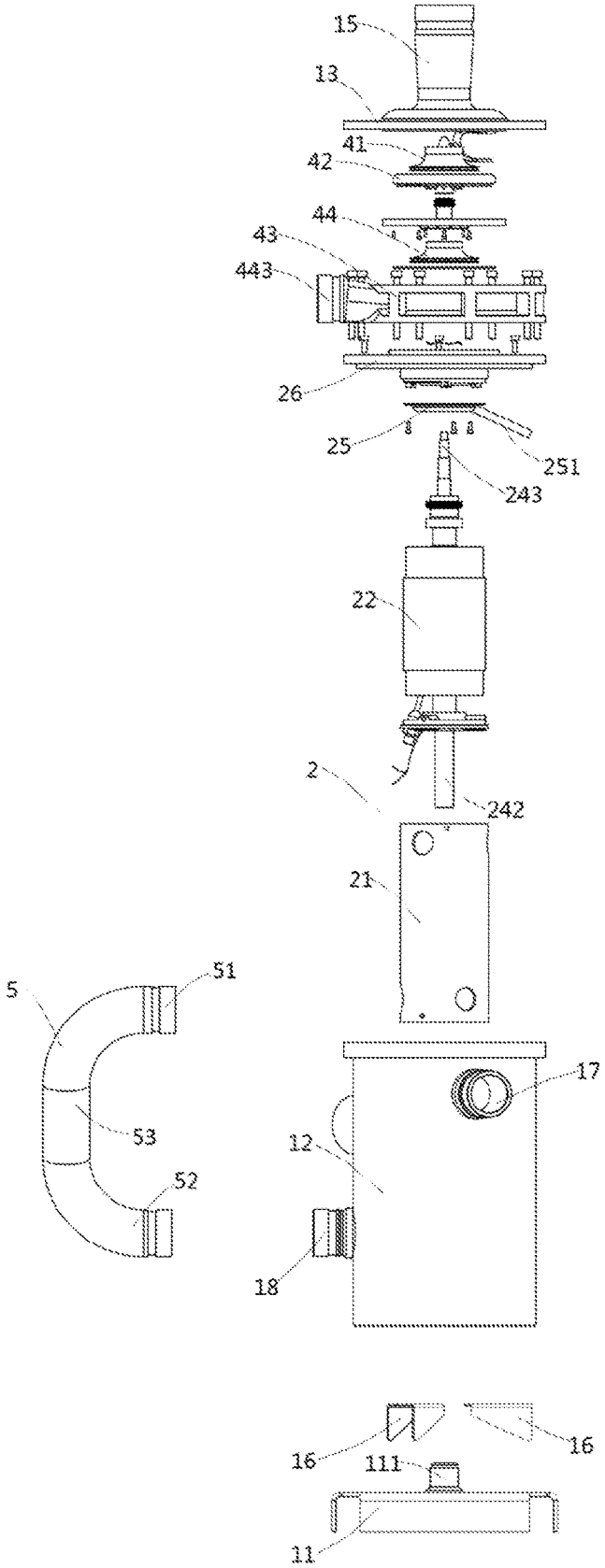
FIG. 2 shows an exploded view of a centrifugal compressor according to an embodiment of the present disclosure.

Referring to FIGS. 1 and 2, a centrifugal compressor is shown, which includes: a shell 1, which has a fluid inlet 15 and a fluid outlet 17, the fluid inlet 15 being located at a top of the shell; a motor assembly 2, which is arranged in the shell 1 and includes a stator 23 and a rotor, wherein the rotor includes a rotor shaft 24, and the rotor shaft 24 includes a lower end 242 and an upper end 243; a centrifugal compression mechanism 4, impellers 41, 44 of which are connected with the rotor shaft 24 (such as its upper end 243) so as to be driven by the motor assembly 2, wherein the centrifugal compression mechanism is arranged downstream of the fluid inlet 15 (such as directly below the fluid inlet 15) to receive fluid, compress and pressurize the fluid, and output the pressurized fluid in a direction away from the motor assembly 2; and a guide member 5, which receives the pressurized fluid from the centrifugal compression mechanism 4, and which defines a flow passage alone or together with a part of the shell, wherein the flow passage is configured such that the pressurized fluid from the centrifugal compression mechanism 4 passes through the motor assembly 2 and is discharged from the fluid outlet 17, substantially as indicated by the hollow arrows.

In the centrifugal compressor according to the embodiment of the present disclosure, after entering the shell through a suction chamber, the fluid can immediately enter the centrifugal compression mechanism 4, and is compressed and pressurized by the centrifugal compression mechanism 4. For example, after a two-stage compression and pressurization, the fluid is then guided and diverted by the guide member 5 to return to the shell 1, thereby cooling the motor assembly 2, including passing through a gap G2 between the rotor and the stator and an outer side of a motor housing 21; then, the fluid is discharged from the fluid outlet 17. A feature of the centrifugal compressor according to the embodiments of the present disclosure is that the compressed gas is guided to pass through the motor assembly, thereby cooling the motor assembly. Since the fluid according to the embodiment of the present disclosure passes through the centrifugal compression mechanism 4 from top to bottom, when the centrifugal compression mechanism 4 is working, the impellers thereof will exert an upward force on the rotor shaft 24, which counteracts the gravity of the rotor shaft 24 itself, thereby reducing axial stress of bearings 31 and 32 that support the rotor shaft 24. In addition, the device according to this embodiment provides a centrifugal compressor with a compact design so as to be applied to low-power operating conditions.

In some embodiments, the guide member 5 may be formed as a pipe as shown in FIG. 1. In an alternative embodiment, the guide member 5 may form a guide passage together with an outer wall of the shell 1, or the guide member 5 divides an inner part of the shell 1 into compartments to guide the fluid. In an alternative embodiment, the guide member 5 may be one piece or formed by multiple parts combined together. In the embodiment shown in FIG. 1, the guide member 5 is partially or completely located outside the shell 1; in other words, it has a part extending outside the shell 1. In the illustrated embodiment, the guide member 5 has a first end 51 connected to an output port 443 of the centrifugal compression mechanism, a second end 52 connected to a side wall of the shell, such as a lower part of the side wall of the shell 1, and a pipe body 53 connected between the first end 51 and the second end 52 and including curved parts 531 and 532. In some embodiments, the guide member 5 diverts the fluid flowing out of the centrifugal compression mechanism 4 by about 180 degrees for example, such as 150 degrees to 210 degrees. For example, from a direction substantially away from the motor assembly 2, the fluid is diverted into a direction approaching the motor assembly 4, and then returns to the interior of the shell 1 and cools the motor assembly 2. As shown in FIG. 1, in some embodiments, the second end 52 of the guide member 5 may extend into the shell 1 and be aligned with an opening 211 at the bottom of the motor housing 21. There may be a gap G1 between the second end 52 and the opening 211, so that the airflow from the guide member 5 partially passes through the gap G2 between the motor stator and the rotor, and partially passes through the space between the motor assembly and the shell 1. The top of the motor housing 21 may also have an opening 212 to allow the airflow that have passed through the gap G2 to exit, and an oil guide pipe 251 may extend out of the opening 212. In some embodiments, the fluid outlet 17 of the shell 1 may be aligned with or adjacent to the opening 212 so that the airflow can be easily discharged. In some embodiments, the fluid outlet 17 may be arranged at other positions, for example, a position higher than a connection 18 between the second end 52 of the guide member 5 and the shell 1, such as being flush with the opening 212 at a higher position of the motor housing 21.

In the illustrated embodiment, the rotor shaft 24 is supported by a first bearing 31 at a lower part and a second bearing 32 at an upper part. The first bearing 31 is disposed in a first bearing seat 27 at the bottom of the motor assembly 2, and the second bearing 32 is disposed in a second bearing bracket 26 at the top of the motor assembly. The shell 1 substantially includes a bottom part 11, a middle part 12 and a top part 13, and may have an overall substantially cylindrical shape. The fluid inlet 15 may be formed as a pipe, which may extend in an axial direction or vertical direction, and may be aligned with an inlet of the centrifugal compression mechanism 4. The bottom part 11 of the shell 1 defines at least a portion of an oil tank. Oil for the first bearing 31, the second bearing 32 and other optional members may be contained in the oil tank. The lower end 242 of the rotor shaft 24 may be located in the oil tank; specifically, it may be inserted into a limiting member 111 in the oil tank. The rotor shaft 24 defines an axial or slightly oblique oil passage 241 therein. For example, as shown, the rotor shaft may be formed as a hollow member with an oil passage 241 therein. The oil passage 241 may be straight (in the axial direction of the rotor shaft 24) or oblique. The rotor shaft 24 has radial perforations 246 and 247 at positions corresponding to the first bearing 31 and the second bearing 32, respectively. When the centrifugal compressor is working, the rotation of the rotor shaft 24 will generate negative pressure in the oil passage 241, so that the oil in the oil tank is drawn through the oil passage 241 in the direction of the arrows, and the oil will flow radially out of the perforations 246, 247 under centrifugal force, thereby lubricating the first bearing 31 and the second bearing 32. The oil that has passed through and lubricated the first bearing 31 directly returns to the oil tank under gravity. An oil cup 25 is arranged below the second bearing 32. The oil that has passed through and lubricated the second bearing 32 falls into the oil cup 25, is guided to an inner side of a side wall of the shell through the obliquely arranged oil guide pipe 251, and returns to the oil tank along the inner side of the side wall of the shell. The arrangement of the oil cup 25 and the oil guide pipe 251 prevents the lubrication oil from entering the interior of the motor assembly. In some embodiments, a diameter of the perforation 246 corresponding to the first bearing 31 may be smaller than a diameter of the perforation 247 corresponding to the second bearing 32 to prevent the oil from flowing out of the perforation 246 too much to reach the perforation 247.

With reference to FIGS. 1 and 2, in the illustrated embodiment, the motor assembly may include: a motor housing 21; a stator 22 fixed on an inner side of the motor housing 21; and a rotor located radially inwardly of the stator. In some embodiments, the rotor may include a rotor shaft 24 and a permanent magnet 23, and the stator 22 may have a winding. When the stator 22 is energized, the rotor is capable of rotating relative to the stator 22. The motor assembly may further include: a first bearing seat 27 at a bottom of the motor housing 21 and a first bearing 31 therein; an oil cup 25 at a top of the motor housing 21; and a second bearing bracket 26 located above the oil cup 25 and a second bearing 32 therein. In an alternative embodiment, the motor assembly may have other suitable structures and components. In the illustrated embodiment, the bottom of the motor housing 21 is connected to the shell 1 through several support brackets 16. For example, the bottom is connected to the inner side of the side wall of the shell 1. The top of the motor housing 21 is connected to the second bearing bracket 26, and the second bearing bracket 26 is mounted on the shell 1, such as being directly supported on the middle part 12 of the shell 1 or connected to the inner wall of the shell 1.

The centrifugal compression mechanism 4 is arranged on the second bearing bracket 26. For example, in some embodiments, a volute 43 of the centrifugal compression mechanism may be directly arranged on the second bearing bracket 26. Although shown in the drawings, the centrifugal compression mechanism 4 includes two stages consisting of a first-stage impeller 41 and a second-stage impeller 44. In an alternative embodiment, the centrifugal compression mechanism 4 may only include one stage or more than two stages. In the illustrated embodiment, the centrifugal compression mechanism 4 includes the first-stage impeller 41, a partition 42, the volute 43, and the second-stage impeller 44, through which the rotor shaft 24 passes. The first-stage impeller 41 and the second-stage impeller 44 are connected to the rotor shaft 24 and rotate with the rotor shaft, whereas the partition 42 and the volute 43 are relatively fixed. A first sleeve 61 is arranged between the first-stage impeller 41 and the second-stage impeller 44, and a second sleeve 62 is arranged between the second-stage impeller 44 and the second bearing 32. In the illustrated embodiment, the output port 443 of the volute 43 is in communication with the first end 51 of the guide member 5. The fluid entering the centrifugal compression mechanism 4 through the fluid inlet 15 is compressed by the first-stage impeller 41 and then passes between an upper surface of the volute 43 and the partition 42. Then, the fluid is compressed by the second-stage impeller 44, exits from the output port 443 of the volute, and enters the flow passage defined by the guide member 5. In an alternative embodiment, the volute 43 may include a second fluid inlet for connection with an economizer.

In another aspect, a refrigerating device is provided, which includes the centrifugal compressor according to various embodiments.

The specific embodiments described above are merely for describing the principle of the present disclosure more clearly, and various components are clearly illustrated or depicted to make it easier to understand the principle of the present disclosure. Those skilled in the art can readily make various modifications or changes to the present disclosure without departing from the scope of the present disclosure. Therefore, it should be understood that these modifications or changes should be included within the scope of protection of the present disclosure.

What is claimed is:

1. A centrifugal compressor, comprising:

a shell, which has a fluid inlet and a fluid outlet, the fluid inlet being located at a top of the shell;

a motor assembly, which is arranged in the shell and comprises a stator and a rotor, the rotor comprising a vertically arranged rotor shaft, and the rotor shaft comprising a lower end and an upper end;

a centrifugal compression mechanism, an impeller of which is connected with the rotor shaft so as to be driven by the motor assembly, wherein the centrifugal compression mechanism is arranged downstream of the fluid inlet to receive fluid, compress and pressurize the fluid, and output the pressurized fluid in a direction away from the motor assembly; and a guide member, which receives the pressurized fluid from the centrifugal compression mechanism, and which defines a flow passage alone or together with a part of the shell, wherein the flow passage is configured such that the pressurized fluid from the centrifugal compression mechanism passes through and cools the motor assembly and is discharged from the fluid outlet;

wherein the guide member has a first end connected to an output port of the centrifugal compression mechanism, a second end connected to the side wall of the shell, and a pipe body connected between the first end and the second end;

wherein the motor assembly comprises:

a motor housing;

the stator fixed on an inner side of the motor housing;

the rotor located radially inwardly of the stator, the rotor being capable of rotating relative to the stator when the motor assembly is energized;

a first bearing seat at a bottom of the motor housing and a first bearing therein;

an oil cup at a top of the motor housing; and a second bearing bracket located above the oil cup and a second bearing therein.

2. The centrifugal compressor according to claim 1, wherein the bottom of the motor housing is connected to the shell through a support bracket, the top of the motor housing is connected to the second bearing bracket, and the second bearing bracket is supported by the shell.

3. A refrigerating device, comprising the centrifugal compressor according to claim 1.

4. A centrifugal compressor, comprising:

a shell, which has a fluid inlet and a fluid outlet, the fluid inlet being located at a top of the shell;

a motor assembly, which is arranged in the shell and comprises a stator and a rotor, the rotor comprising a vertically arranged rotor shaft, and the rotor shaft comprising a lower end and an upper end;

a centrifugal compression mechanism, an impeller of which is connected with the rotor shaft so as to be driven by the motor assembly, wherein the centrifugal compression mechanism is arranged downstream of the fluid inlet to receive fluid, compress and pressurize the fluid, and output the pressurized fluid in a direction away from the motor assembly; and a guide member, which receives the pressurized fluid from the centrifugal compression mechanism, and which defines a flow passage alone or together with a part of the shell, wherein the flow passage is configured such that the pressurized fluid from the centrifugal compression mechanism passes through and cools the motor assembly and is discharged from the fluid outlet;

wherein the guide member has a first end connected to an output port of the centrifugal compression mechanism, a second end connected to the side wall of the shell, and a pipe body connected between the first end and the second end; and an oil recirculation path comprising:

an oil tank below the motor assembly;

a first oil passage defined inside the rotor shaft;

perforations in the rotor shaft;

a first bearing below the motor assembly;

a second bearing above the motor assembly;

an oil cup below the second bearing;

an oil guide pipe coupled to the oil cup; and a second oil passage along an inner side of a side wall of the shell;

wherein oil recirculation operations of the centrifugal compressor are through the oil recirculation path;

wherein the centrifugal compression mechanism operating draws oil from the oil tank into the first oil passage, through the perforations, and through the first bearing and the second bearing;

wherein oil that has passed through the first bearing returns to the oil tank under gravity; and wherein oil that has passed through the second bearing, into the oil cup, through the oil guide pipe, and along the second oil passage returns to the oil tank under gravity.

5. The centrifugal compressor according to claim 4, wherein the guide member comprises a pipe partially or completely located outside the shell.

6. The centrifugal compressor according to claim 4, wherein the pipe body connected between the first end and the second end and comprises a curved part.

7. The centrifugal compressor according to claim 4, wherein the rotor shaft is supported by the first bearing at a lower part and the second bearing at an upper part, a bottom part of the shell defines at least a portion of the oil tank, and the lower end of the rotor shaft is located in the oil tank.

8. The centrifugal compressor according to claim 4, wherein the centrifugal compression mechanism comprises one or more compression stages.

9. The centrifugal compressor according to claim 8, wherein the centrifugal compression mechanism comprises a first-stage impeller, a partition, a volute, and a second-stage impeller, and wherein an outlet of the volute communicates with the fluid outlet of the shell, the fluid passes between an upper surface of the volute and the partition after being compressed by the first-stage impeller, is then compressed by the second-stage impeller, and then exits via the outlet of the volute.

* * * * *